US007793591B1

(12) United States Patent
Van Stratum

(10) Patent No.: US 7,793,591 B1
(45) Date of Patent: Sep. 14, 2010

(54) PROJECTILE HAVING IGNITABLE PAYLOAD WITH DELAY COLUMN IGNITER

(75) Inventor: Bruce G. Van Stratum, Tallahassee, FL (US)

(73) Assignee: Martin Electronics, Perry, FL (US)

( * ) Notice: Subject to any disclaimer, the term of this patent is extended or adjusted under 35 U.S.C. 154(b) by 604 days.

(21) Appl. No.: 11/810,598

(22) Filed: Jun. 6, 2007

(51) Int. Cl.
*F42B 5/16* (2006.01)

(52) U.S. Cl. ..... 102/443; 102/434; 102/477; 102/478; 102/513; 102/336; 102/342

(58) Field of Classification Search ..... 102/443, 102/434, 477, 478, 513, 336, 342
See application file for complete search history.

(56) References Cited

U.S. PATENT DOCUMENTS 3,528,662 A * 9/1970 Engle et al. ..... 473/577
3,771,451 A * 11/1973 Woodring ..... 102/430
3,967,552 A * 7/1976 Settles et al. ..... 102/430
3,983,817 A * 10/1976 Tucker ..... 102/513
4,301,732 A * 11/1981 Van Sickle ..... 102/430
4,892,038 A * 1/1990 Lubbers ..... 102/439
5,408,931 A * 4/1995 Tallman ..... 102/439
5,429,054 A * 7/1995 Topping ..... 102/458
5,936,189 A * 8/1999 Lubbers ..... 102/439
6,041,712 A * 3/2000 Lyon ..... 102/439
7,004,074 B2 * 2/2006 Van Stratum ..... 102/470
2008/0053330 A1 * 3/2008 Haeselich ..... 102/513

* cited by examiner

*Primary Examiner*—Michelle Clement
(74) *Attorney, Agent, or Firm*—J. Wiley Horton

(57) ABSTRACT

A modified projectile round which is configured to function with a propellant cartridge such as described in U.S. Pat. No. 7,004,074. The projectile assembly uses a High-Low gas pressure cartridge to launch the projectile. When the high pressure cartridge is ignited, hot propellant gases rupture a burst cup and shoot propellant gases toward the aft end of the projectile. The hot propellant gases impinge against a delay carrier located in the aft end of the projectile. The contents of the delay carrier are thereby ignited. The delay carrier includes one or more delay columns ultimately terminating in an igniter charge. The delay columns burn as the projectile is in flight. A specified amount of time later, the igniter charge ignites an ignitable payload—such as a marker flare candle.

20 Claims, 8 Drawing Sheets

PROJECTILE HAVING IGNITABLE PAYLOAD WITH DELAY COLUMN IGNITER

BACKGROUND OF THE INVENTION

1. Field of the Invention

This invention relates to the field of gas-propelled projectiles. More specifically, the invention comprises a marker flare projectile having an improved delay column ignition system 2. Description of the Related Art Although the present invention can be configured to operate from a variety of different launchers, it was primarily developed to be fired from launchers adapted to fire 40 mm grenades (such as the U.S. Army's M433). The invention incorporates elements from a prior design reduced to practice by the same inventor. The prior design is disclosed and claimed in U.S. Pat. No. 7,004,074 to Van Stratum (2006), which is hereby expressly incorporated by reference.

Gas-propelled projectiles typically use solid propellant encapsulated in a cartridge case. A projectile is seated in the open mouth of the cartridge case. Ignition of the propellant is provided by percussive or electrical means. The burning propellant generates pressurized gas which forces the projectile out of the mouth of the case and then typically through a barrel bore.

This type of system is typically used to launch 40 mm grenades. The same approach can be used to launch other types of projectiles, however. An example of such a projectile is a marker flare. A marker flare projectile has a mass which is similar to that of a grenade round. Thus, the propulsion system developed for use with grenade rounds can be used to launch a marker flare. The incorporated U.S. Pat. No. 7,004,074 illustrates and describes an effective approach to the problem of launching large masses at low velocities. The '074 invention uses a high-pressure cartridge embedded within a low-pressure larger cartridge. A burst cup metering system is used to meter propellant gases from the high pressure cartridge into the low pressure cartridge, thereby accelerating the projectile in a smooth and controlled fashion. This approach helps to reduce the peak recoil loads experienced by a user. The high pressure found within the high pressure cartridge also ensures the reliable ignition and combustion of the propellant it contains.

The burst cup approach results in hot metered gases exiting the high pressure case in the direction of the mouth of the low pressure case. The present invention makes use of this phenomenon. In addition to propelling the marker flare down the bore of the firing weapon, the hot gases exiting the high pressure case are used to ignite a delay column in the aft end of the marker flare round.

BRIEF SUMMARY OF THE INVENTION

The present invention is a modified marker flare round which is configured to function with a propellant cartridge such as described in U.S. Pat. No. 7,004,074. FIGS. 2 and 3 illustrate the invention's most significant features. FIG. 2 shows a projectile assembly using a High-Low gas pressure cartridge to launch a marker flare round. High pressure chamber 31 is formed within high pressure cartridge 42 (The high pressure chamber is normally filled with solid propellant, which is not shown in the view). Low pressure chamber 30 is formed within low pressure cartridge 38. Burst cup 46 closes the open mouth of the high pressure cartridge.

When the high pressure cartridge is ignited, the solid propellant burns and hot propellant gases rupture the burst cup.

The gases then shoot out through charge vent hole 52 (toward the mouth of low pressure cartridge 38). These propellant gases expel marker flare round 124 from the mouth of the low pressure cartridge and accelerate it down the bore of the weapon.

The hot propellant gases also impinge against the exposed aft end of delay carrier 96. The contents of the delay carrier are thereby ignited. The delay carrier includes one or more delay columns ultimately terminating in a flare igniter charge. The delay columns burn as the marker flare round is in flight. A specified amount of time later, the flare igniter charge ignites the flare itself (generally after the marker flare round has struck the earth and buried its nose cone in the ground). The flare's aft closure is detached from the balance of the round and the flare then burns brightly.

REFERENCE NUMERALS IN THE DRAWINGS

| | | | |
|---|---|---|---|
| 11 | projectile assembly | 12 | low pressure case |
| 14 | projectile | 16 | rifling ring |
| 18 | nose cup | 30 | low pressure chamber |
| 31 | high pressure chamber | 34 | percussion primer |
| 36 | propellant | 38 | low pressure cartridge |
| 42 | high pressure cartridge | 46 | burst cup |
| 52 | charge vent hole | 84 | cushion |
| 86 | tube | 88 | candle |
| 90 | flare sleeve | 92 | potting |
| 94 | aft closure | 96 | delay carrier |
| 98 | igniter charge | 100 | delay column |
| 102 | flare igniter charge | 104 | input opening |
| 106 | output opening | 110 | propellant gases |
| 112 | clevis | 114 | descending flange |
| 116 | tang | 118 | channel |
| 120 | sealant | 122 | ground |

DETAILED DESCRIPTION OF THE INVENTION

Figure 1:
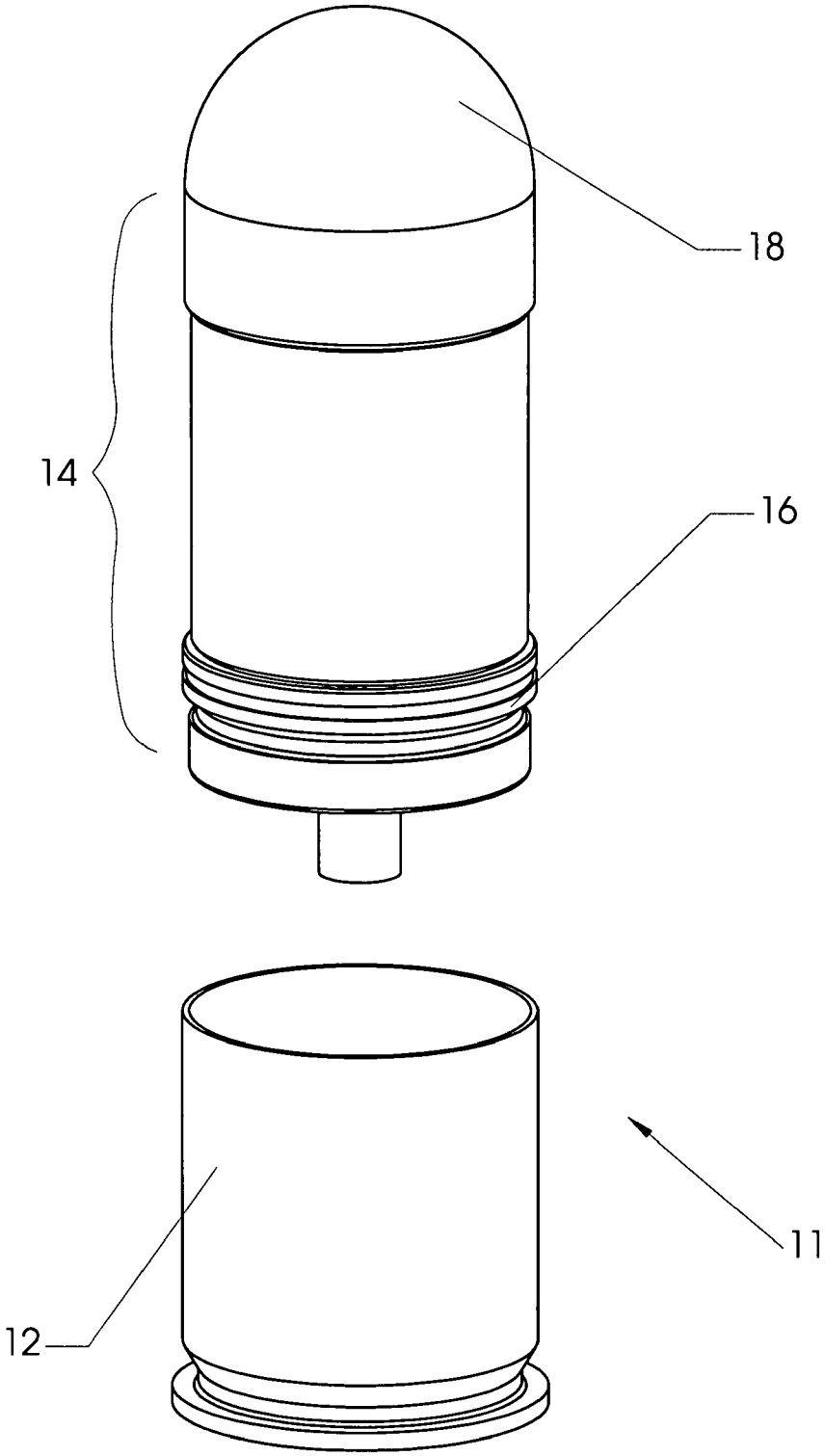
FIG. 1 is an exploded perspective view, showing a projectile assembly.

FIG. 1 shows the major components of a 40 mm projectile round. Projectile 14 is mated with low pressure case 12 to form projectile assembly 11. Those skilled in the art will know that projectile 14 can assume many forms, including a fragmentation grenade, a smoke round, a flare round, etc. It generally includes a rifling ring 16 sized to engage the rifling on the bore of the grenade launching weapon. Nose cone 18 provides an aerodynamically efficient shape.

Figure 2:
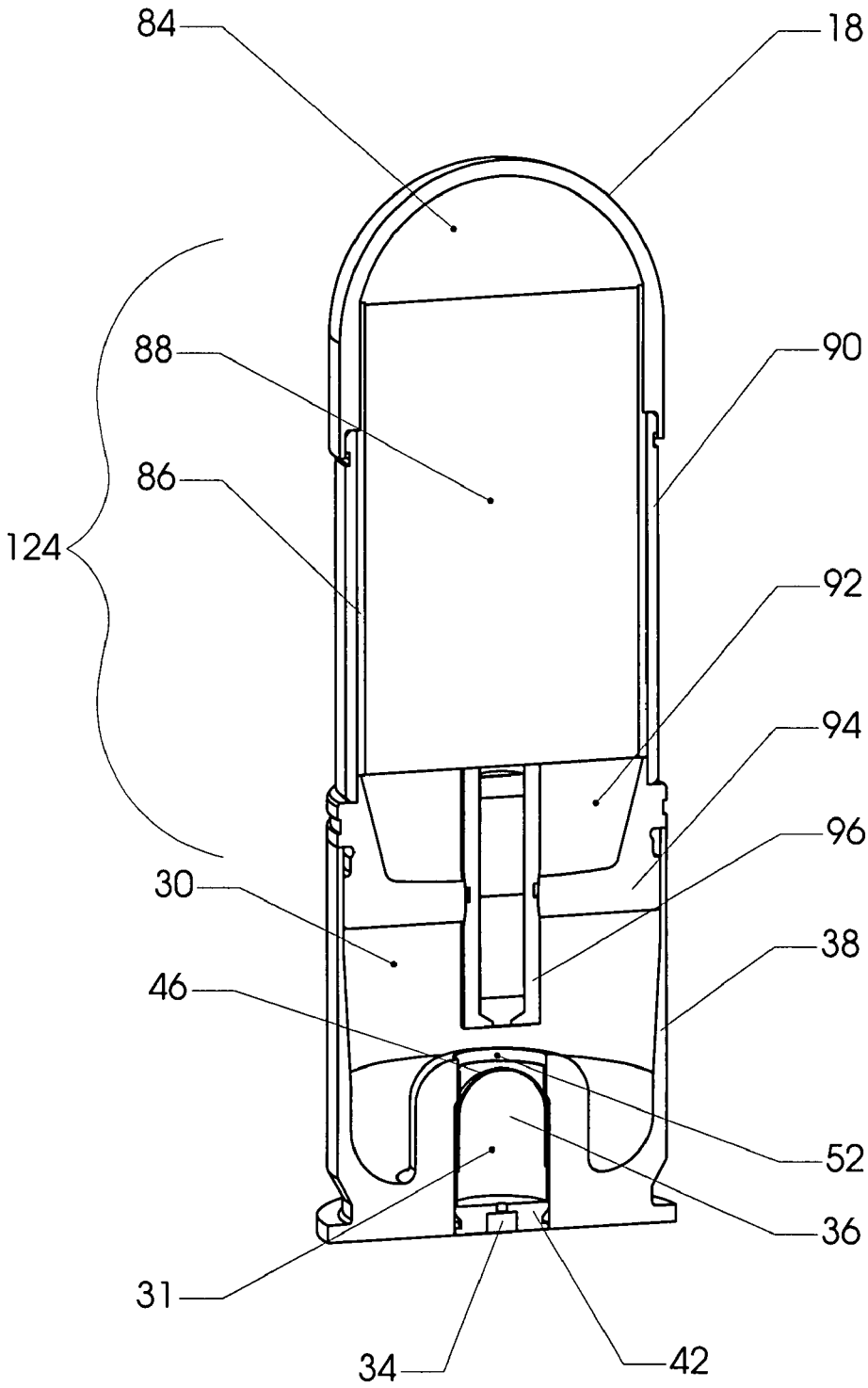
FIG. 2 is a perspective view with a cutaway, showing internal details of the marker flare round cartridge.

FIG. 2 shows projectile assembly 11 sectioned in half to show internal details of the present invention (a marker flare round). The present invention is a cartridge designed to propel a marker flare candle a considerable distance downrange from the firing weapon (typically 400 m to 800 m). The projectile is designed to embed the flare candle into the ground when it strikes, leaving the candle's burning end pointing upward. The flare candle remains in that position as it burns, thereby illuminating a targeted area.

Cylindrical candle 88 is made of suitable flare material. It is housed within hollow cylindrical tube 86. Nose cap 18 covers the forward end of the candle. The nose cap is hollow, leaving a space between the nose cap and the forward end of the candle. This space is preferably filled by cushion 84, which is made of a low density foam.

The aft end of the candle is covered by aft closure 94. Aft closure 94 is connected to flare sleeve 90 by conventional means, such as a threaded engagement. Flare sleeve 90 is a hollow cylinder which slides over tube 86. The forward extreme of the flare sleeve engages with the aft extreme of nose cap 18 in a sliding fit (which will be explained in more detail subsequently).

The assembly of aft closure 94, candle 88, tube 86, flare sleeve 90, nose cap 18, and cushion 84 together makes up marker flare round 124. This assembly is expelled from the weapon upon firing, travels downrange, and strikes the target area. Thus, it must be able to withstand the substantial acceleration of the firing cycle as well as the impact with the target. It is therefore important to eliminate any open space within the projectile in order to prevent unwanted deformations. As an example, potting 92 is used to fill a gap existing between aft closure 94 and candle 88. The potting can be any suitable compound which transitions from a liquid to a solid in order to fill the volume.

The reader will note additional significant features of the marker flare round in FIG. 2. Aft closure 94 includes delay carrier 96 located in its center. The delay carrier is positioned directly over high pressure cartridge 42, which is located in the closed base of low pressure cartridge 38. High pressure cartridge 42 (which is described in detail in the incorporated U.S. Pat. No. 7,004,074) has a closed aft end, an open forward end, and a continuous side wall. It contains propellant 36 (The propellant is not shown in the view, but occupies the hollow interior of the high pressure cartridge). The open forward end of the high pressure cartridge is closed by a burstable cover. Upon ignition of percussion primer 34, the propellant within the high pressure cartridge ignites. The hot propellant gases then burst the burstable cover and vent through charge vent hole 52. Thus, a metering system is created in which the hot propellant gases are metered from high pressure chamber 31 into low pressure chamber 30. The gases expel marker flare round 124 from low pressure cartridge 38 and accelerate it down the bore of the firing weapon.

A variety of burstable covers can be used in high pressure cartridge 42, including a simple "wad" crimped into the cartridge's open mouth. However, a hollow hemispherical burst cup 40 is preferably used. This is retained within the high pressure cartridge by a suitable mechanical interference. The burst cup is preferably embossed with rupture lines so that it will burst in a predictable fashion.

Figure 3:
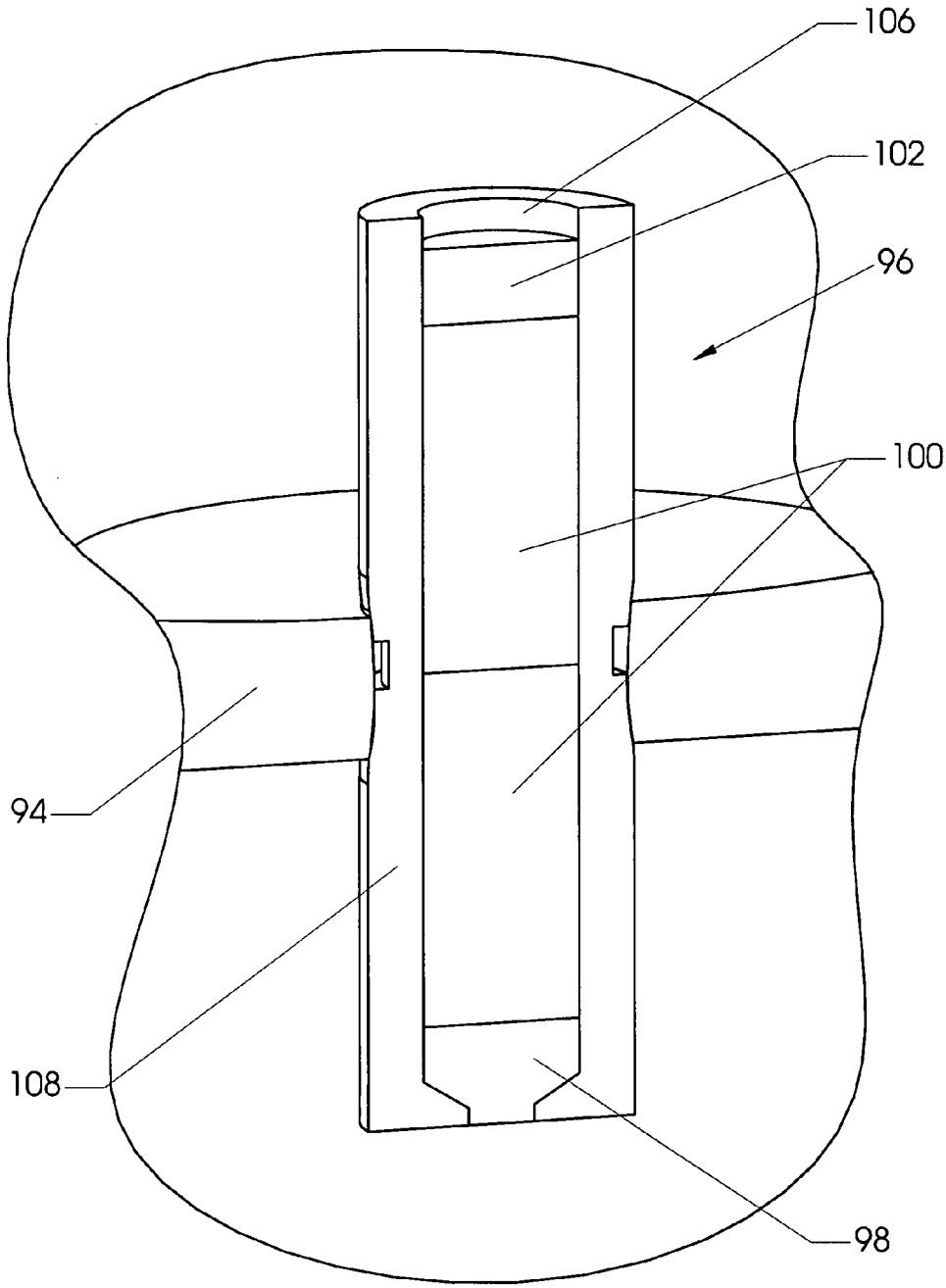
FIG. 3 is a sectioned detail view, showing the composition of the delay carrier.

Delay carrier 96 is aligned with high pressure cartridge 42 so that the propellant gases exiting the high pressure cartridge will strike the aft end of the delay carrier. FIG. 3 shows a sectioned detail view of the delay carrier. The potting surrounding the delay carrier and the flare candle itself have been removed so that the delay column may be fully visualized. Delay carrier 96 holds the components in position. The aft end of the delay carrier opens into input opening 104. The forward end opens into output opening 106. An internal passage connects the input opening to the output opening.

Igniter charge 98 is located within the internal passage proximate input opening 104. When the high pressure cartridge ignites, the hot propellant gases ignite igniter charge 98, which in turn ignites the adjacent delay column 100. Delay column 100 is a specialized type of combustible which takes a fixed amount of time to burn from one end to the other. Two or more such delay columns can be stacked within the passage inside the delay carrier in order to establish a set delay. When the last delay column burns through, it ignites flare igniter charge 102. The flare igniter charge is located proximate a surface of the flare candle, so its ignition actually starts the burning of the flare candle.

It is important that the delay carrier be firmly retained in the aft closure, so that it is not dislodged during the firing cycle. While many methods of securing the delay carrier can be used, one good approach is to peen or otherwise deform a portion of the aft closure into the delay carrier. This plastic deformation will create an interference fit which then securely retains the delay carrier in the aft closure. FIG. 3 depicts such a deformation in the region where the delay carrier meets the aft closure.

Figure 4:
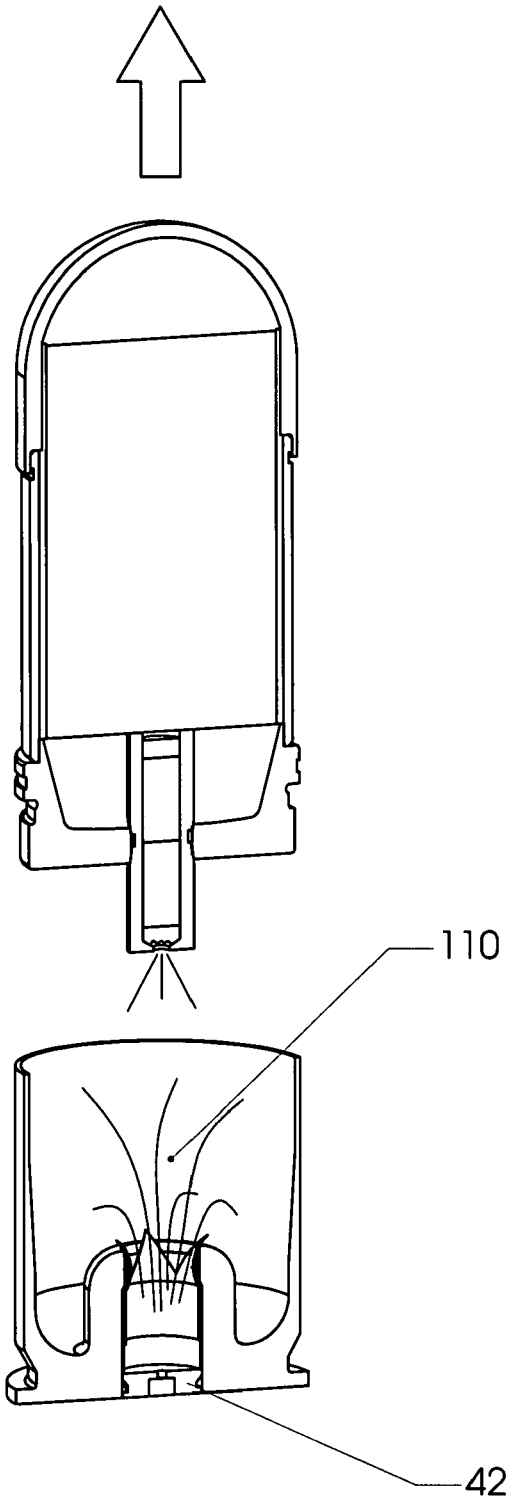
FIG. 4 is a sectional view, showing the ignition of the propellant and the ignition of the delay carrier.

The operation of the marker flare round will now be described, beginning with FIG. 4. FIG. 4 shows the round just after high pressure cartridge 42 has detonated and separated the marker flare round from the low pressure cartridge. Propellant gases 110 impinge upon the aft portion of the delay column, thereby setting off igniter charge 98, which in turn starts the first delay column burning. The projectile passes through the bore of the firing weapon and begins its free flight. Within the delay carrier, the delay columns continue to burn.

It may take many seconds for the projectile to reach the target area and impact the ground. For most applications, it is desirable to light the flare after impact. As an example, two ten-second delay columns can be used to provide a twenty second delay between the ignition of the high pressure cartridge and the ignition of the flare. During this delay, the projectile flies through the air and strikes the ground in the target area.

Figure 5:
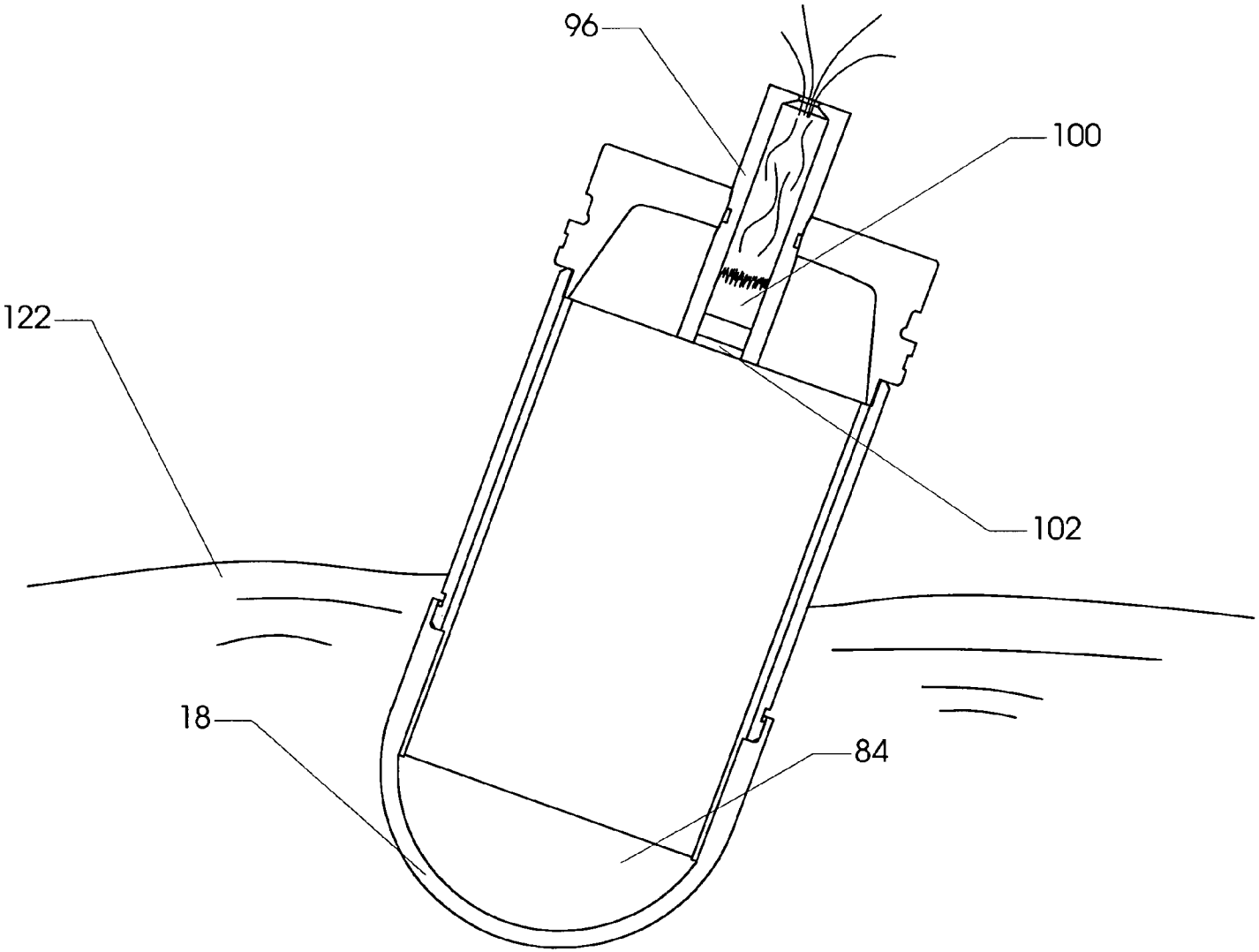
FIG. 5 is a sectioned elevation view, showing the marker flare round after it has impacted the earth.

FIG. 5 shows marker flare round 124 after it has struck ground 122 and embedded its forward portion. Nose cap 18 and cushion 84 absorb the impact forces so that the balance of the projectile remains intact. At this point (depending on the delay configuration selected) the second delay column 100 is still burning toward flare igniter charge 102.

Figure 6:
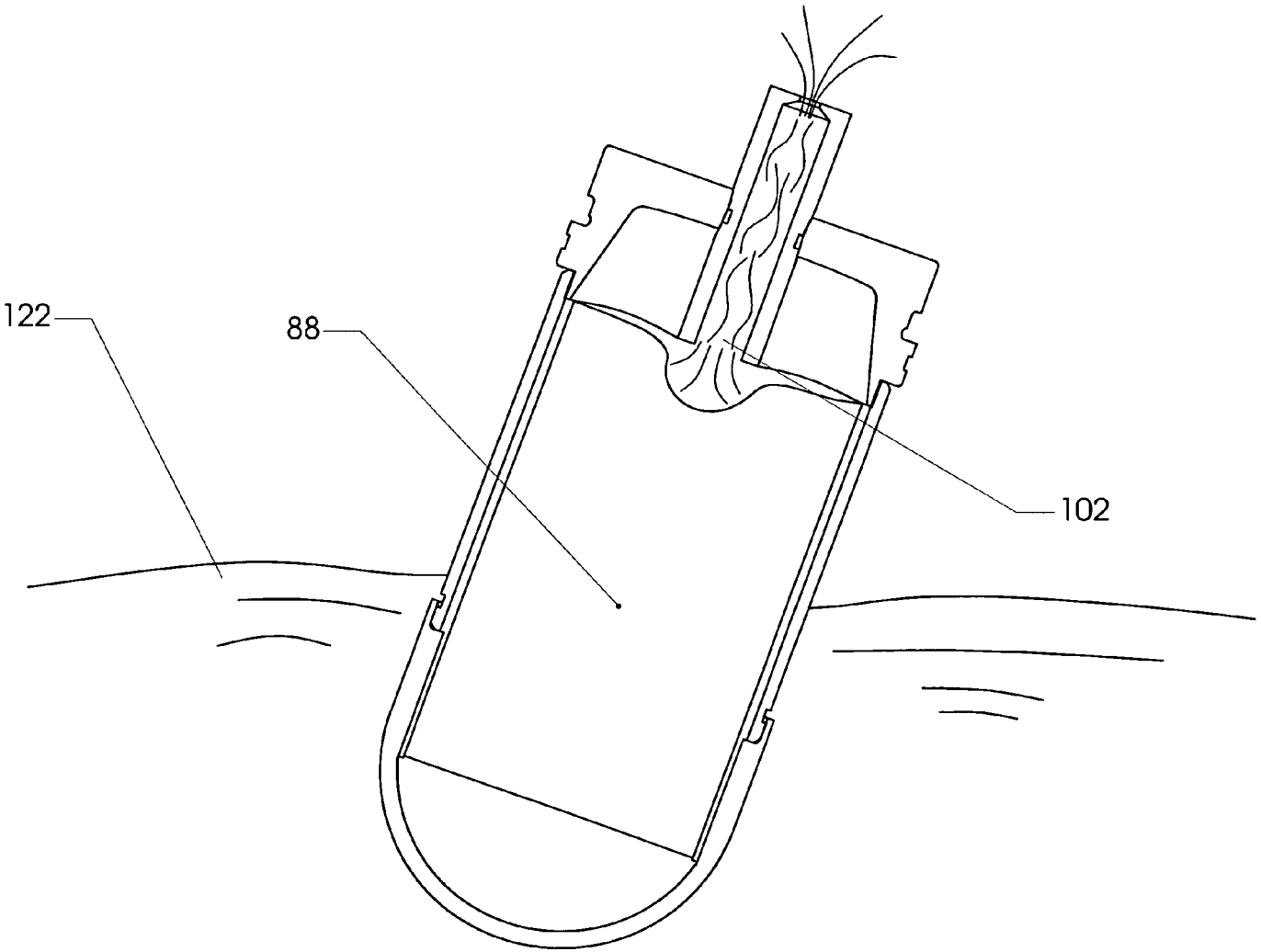
FIG. 6 is a sectioned elevation view, showing the ignition of the flare candle.

In FIG. 6, flare igniter charge 102 has ignited and thereby ignited candle 88. Candle 88 then starts producing a large quantity of hot gas, which builds pressure between the aft end of the candle and the aft closure. In order for the candle to burn freely and illuminate the target area, it is at this point desirable to remove the aft closure. Turning briefly back to FIG. 2, the reader will recall that aft closure 94 and flare sleeve 90 are connected together, with the flare sleeve slidably fitting over tube 86. The forward portion of flare sleeve 90 is also slidably engaged with the aft portion of nose cap 18.

Figure 7:
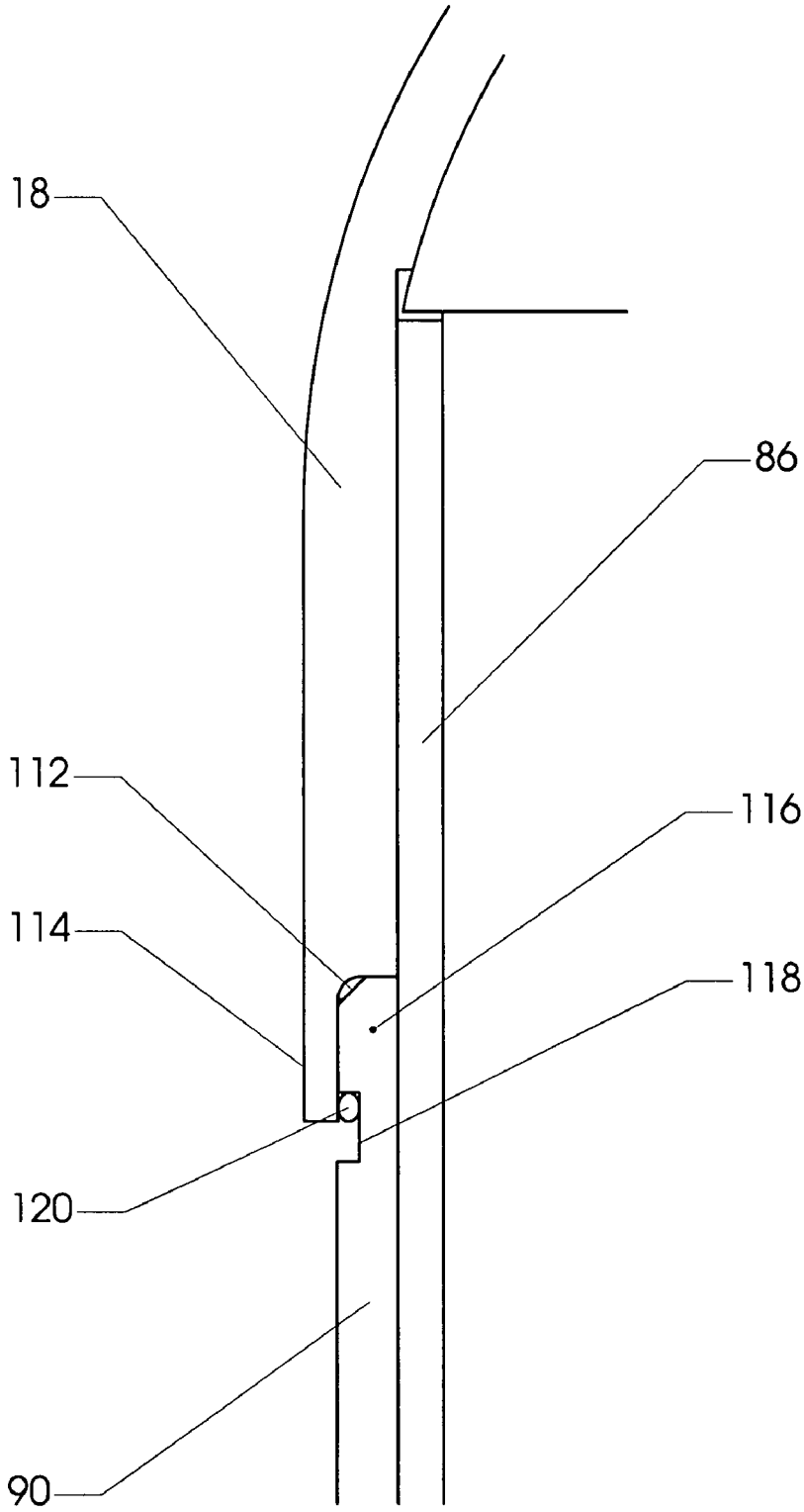
FIG. 7 is a sectioned detail view, showing the joint between the nose cap, tube, and flare sleeve.

FIG. 7 shows the slidable engagement between the forward portion of the flare sleeve and the aft portion of the nose cap in greater detail. The nose cap includes descending flange 114, which in combination with tube 86 creates clevis 112. The forward portion of flare sleeve 90 creates tang 116 which fits snugly into clevis 112. Tang 116 includes a channel 118 extending all the way around the circular cross section of the flare sleeve. Sealant 120 fills this channel. After the flare sleeve is advanced into engagement with the nose cap, sealant 120 is applied. This creates a suitable engagement between the nose cap and the flare sleeve, which prevents the two components from separating prematurely.

Returning now to FIG. 6, the reader will recall that the flare candle has started burning and is producing pressurized gas, which tends to force the aft closure away from the flare candle. The aft closure is retained on the flare candle by the tang and clevis engagement between the nose cap and the flare sleeve. Shortly after the candle starts burning, the tang is forced out of the clevis and the flare sleeve and aft closure are propelled free of the candle (as a unit, since they are connected).

Figure 8:
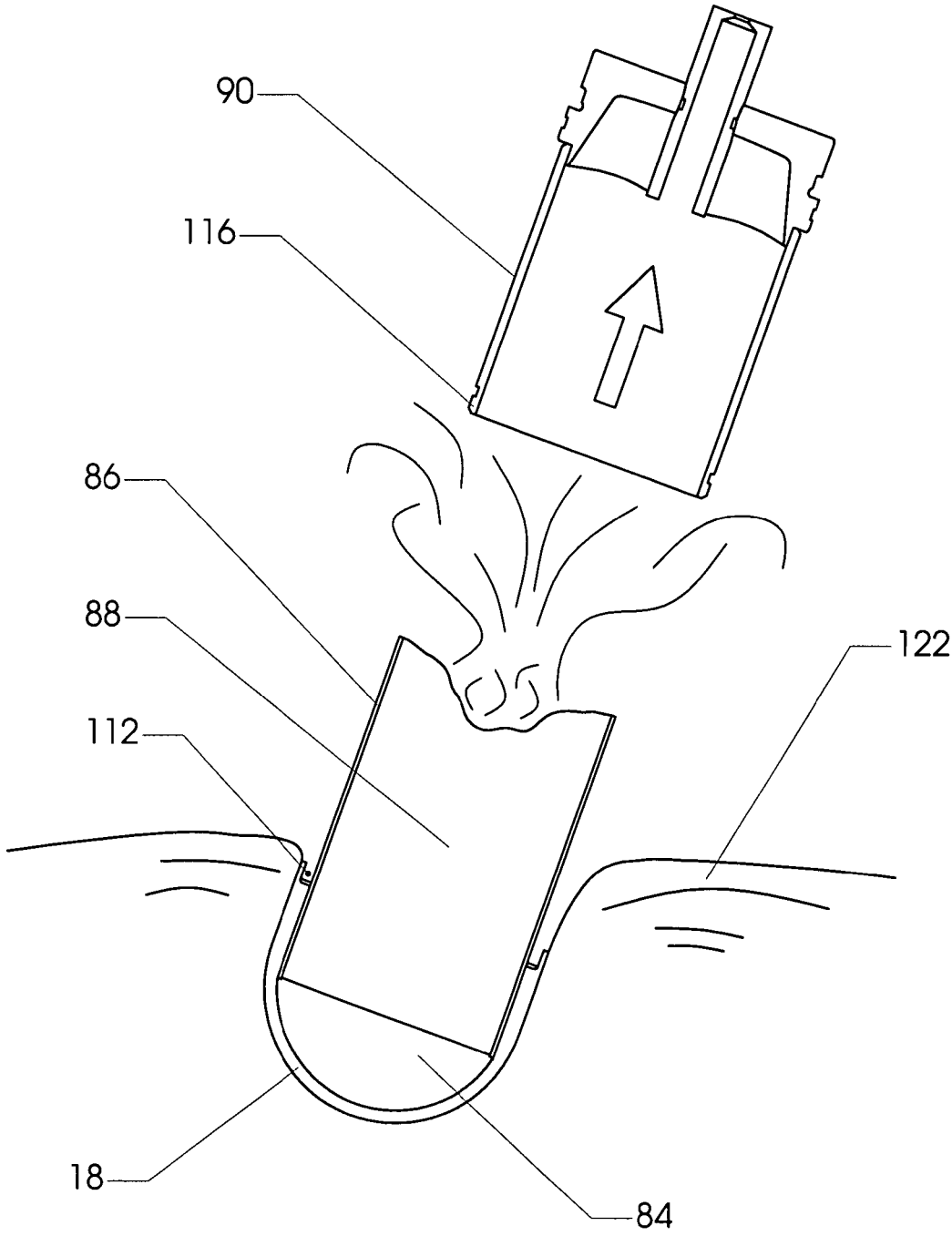
FIG. 8 is a sectioned elevation view, showing the burning of the flare candle and the expulsion of the flare sleeve and aft closure.

FIG. 8 shows this action. Flare sleeve 90, with the aft closure still attached, has been propelled free of tube 86. The candle's burning gases will propel it a short distance away. At this point the flare candle is free to burn. It will emit a bright light until the candle is exhausted.

Looking back at FIG. 2, the reader will note that that flare sleeve 90 is slidably connected to tube 86 rather than directly to candle 88. The tube is a container which holds the candle in a conformed shape and serves to mechanically reinforce the candle material. The tube may therefore be viewed as part of the flare candle itself. Thus, the slidable attachment between the flare sleeve and the tube may be viewed as a slidable attachment between the flare sleeve and the flare candle itself.

Those skilled in the art will realize that the components thus described can be used to create a delayed ignition of many types of ignitable payloads in a projectile round. A marker flare candle is a common example of such an ignitable payload. However, the system described could be used to ignite an explosive payload as well. The explosive payload could be ignited while airborne (using a short delay in the delay carrier) or after it has landed in the target area (using a long delay in the delay carrier). The system could also be used to ignite a smoke-generating payload.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A projectile cartridge assembly, comprising:

a. a low pressure cartridge, having a first end and an open second end;

b. a high pressure cartridge located in said first end of said low pressure cartridge, said high pressure cartridge including i. propellant;

a burstable seal sealing said high pressure cartridge, configured so that when said propellant is ignited, said burstable seal bursts to allow hot propellant gases to escape toward said open second end of said low pressure cartridge;

c. a projectile, seated in said open second end of said low pressure cartridge, said projectile including i. an ignitable payload, having a forward end and an aft end;

ii. an aft closure located proximate said aft end of said ignitable payload;

iii. a delay carrier attached to said aft closure;

iv. wherein said delay carrier includes an input opening facing said low pressure cartridge and an output opening facing said ignitable payload;

v. wherein said input opening is connected to said output opening by a passage through said delay carrier;

vi. an igniter charge inside said passage proximate said input opening;

vii. an output charge inside said passage proximate said output opening;

viii. at least one delay column inside said passage lying between said igniter charge and said output charge;

d. a sleeve surrounding said ignitable payload, with said sleeve being slidably attached to said ignitable payload; and e. wherein said sleeve is attached to said aft closure, so that when said output charge ignites said ignitable payload, said sleeve and said aft closure will be propelled away from said ignitable payload as a unit.

2. A projectile cartridge assembly as recited in claim 1, wherein said delay carrier comprises a plurality of delay columns in said passage lying between said igniter charge and said output charge, wherein said delay columns are stacked in series.

3. A projectile cartridge assembly as recited in claim 2, wherein said burstable seal comprises a burst cup retained within said high pressure cartridge.

4. A projectile cartridge assembly as recited in claim 2, further comprising a nose cap covering said forward end of said ignitable payload.

5. A projectile cartridge assembly as recited in claim 4, further comprising a cushion located between said nose cap and said forward end of said ignitable payload.

6. A projectile cartridge assembly as recited in claim 2, wherein said sleeve is attached to said aft closure by a threaded engagement.

7. A projectile cartridge assembly as recited in claim 2, wherein a portion of said aft closure is plastically deformed in order to create an interference fit with said delay carrier, thereby retaining said delay carrier in said aft closure.

8. A projectile cartridge assembly as recited in claim 2, wherein said aft closure further comprises a plurality of rifling rings extending outward therefrom.

9. A projectile cartridge assembly as recited in claim 1, wherein said burstable seal comprises a burst cup retained within said high pressure cartridge.

10. A projectile cartridge assembly as recited in claim 1, further comprising a nose cap proximate said forward end of said ignitable payload.

11. A projectile cartridge assembly as recited in claim 10, further comprising a cushion located between said nose cap and said forward end of said ignitable payload.

12. A projectile cartridge assembly as recited in claim 11, further comprising:

a.

wherein said sleeve has a forward end and an aft end;

b. wherein said forward end of said sleeve is detachably connected to said nose cap; and d. wherein said aft end of said sleeve is attached to said aft closure by a threaded engagement.

13. A projectile cartridge assembly as recited in claim 10, wherein said sleeve is attached to said aft closure by a threaded engagement.

14. A projectile cartridge assembly as recited in claim 13, wherein a portion of said aft closure is plastically deformed in order to create an interference fit with said delay carrier, thereby retaining said delay carrier in said aft closure.

15. A projectile cartridge assembly as recited in claim 13, wherein said aft closure further comprises a plurality of rifling rings extending outward therefrom.

16. A projectile cartridge assembly as recited in claim 1, wherein said sleeve is attached to said aft closure by a threaded engagement.

17. A projectile cartridge assembly as recited in claim 16, wherein a portion of said aft closure is plastically deformed in order to create an interference fit with said delay carrier, thereby retaining said delay carrier in said aft closure.

18. A projectile cartridge assembly as recited in claim 16, wherein said aft closure further comprises a plurality of rifling rings extending outward therefrom.

19. A projectile cartridge assembly as recited in claim 1, wherein a portion of said aft closure is plastically deformed in order to create an interference fit with said delay carrier, thereby retaining said delay carrier in said aft closure.

20. A projectile cartridge assembly as recited in claim 1, wherein said aft closure further comprises a plurality of rifling rings extending outward therefrom.

* * * * *